United States Patent [19]

Thornborrow

[11] Patent Number: 4,795,039

[45] Date of Patent: Jan. 3, 1989

[54] DISPLAY APPARATUS

[75] Inventor: John W. T. K. Thornborrow, Woodley, England

[73] Assignee: J R Group PLC, Reading, England

[21] Appl. No.: 41,822

[22] Filed: Apr. 16, 1987

[30] Foreign Application Priority Data

Apr. 17, 1986 [GB] United Kingdom ..... 8609419
Jun. 25, 1986 [GB] United Kingdom ..... 8615505

[51] Int. Cl.[4] ..... A47H 1/02
[52] U.S. Cl. ..... 211/105.1; 211/181
[58] Field of Search ..... 211/105.1, 193, 208, 211/111, 107, 112, 204; 248/220.2; 256/65, 22; 40/605

[56] References Cited

U.S. PATENT DOCUMENTS 170,850 12/1875 Harding ..... 256/22
1,282,557 10/1918 Feldtkeller ..... 211/208 X
1,656,024 1/1928 Stewart ..... 256/65
2,773,473 12/1956 Martin ..... 248/220.2 X
3,680,712 8/1972 Jurasek ..... 211/181
4,234,094 11/1980 Jorgensen ..... 248/220.2 X

*Primary Examiner*—Reinaldo P. Machado
*Assistant Examiner*—Sarah A. Lechok Eley
*Attorney, Agent, or Firm*—Finnegan, Henderson, Farabow, Garrett & Dunner

[57] ABSTRACT

Display apparatus is provided comprising a display panel (5) having a series of parallel spaced elongate portions (1) and supporting means (8) extending transversely of the elongate portions (1), and at least one bracket member (10) having engaging means (9) insertable between adjacent elongate portions (1) and engageable with the supporting means (8). It is further provided that the elongate members (1) comprise either separate slat members (1) or ribs or corrugations (1) on a panel member (5).

10 Claims, 2 Drawing Sheets

DISPLAY APPARATUS

Figure 1:
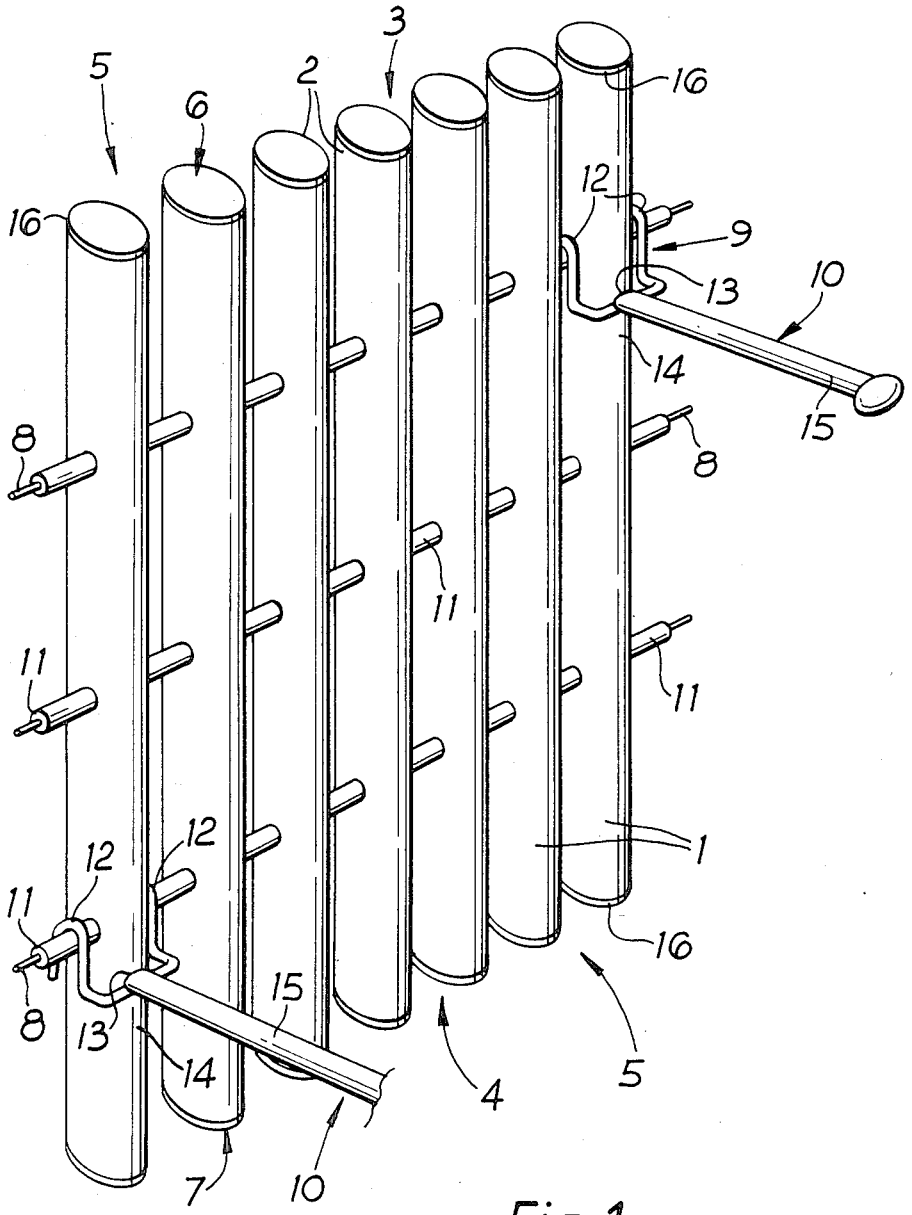

This invention concerns display apparatus, and more particularly display apparatus for use as shop fittings and the like for displaying goods.

Display apparatus currently in use in shops and the like, and particularly such apparatus when placed against a wall have been found to give an effect of diminished height to the room in which they are erected. This effect of diminished height is the opposite of that desired in modern low ceiling buildings, and there arises a need to provide such display apparatus which will, if possible, create an effect on enhanced height to a room whilst being suitable for hanging goods in any desired position thereon.

According to the present invention there is provided display apparatus comprising a display panel having a series of parallel spaced elongate portions and supporting means extending transversely of the elongate portions, and at least one bracket member having engaging means insertable between adjacent elongate portions and engageable with the supporting means.

The elongate portions of the display panel may comprise separate elongate members such as slat members and said supporting means may comprise connecting means for connecting together the elongate portions. Alternatively, the elongate portions may comprise ribs or corrugations on a panel member and said supporting means may comprise one or more rod or like members extending through said elongate portions, e.g., through apertures therein. Preferably the ends of said elongate portions define top and bottom edges of the display panel when the display panel is in its position of use.

The display apparatus may be mounted in any manner desired, for example againsts a wall, suspended from a ceiling, or mounted in free-standing fashion between suitable support means. A said bracket member, it will be appreciated, may be engaged with the display panel from either side thereof, thus allowing goods to be displayed on both sides of the display apparatus when the mounting of the display apparatus so permits.

In order to create an effect of enhanced height of the display apparatus, and of a room in which it is positioned, it is preferred that the elongate portions extend from top to bottom of the display panel and are more closely spaced from one another than are the supporting means, and preferably the elongate portions are more substantial in cross-section, and more preferably considerably more substantial in cross-section, than the supporting means. A preferred ratio of spacing between adjacent extremities of the slat members and the connecting means respectively would be of the order of 1:4, and as between centres would be of the order of 1:3 in order to provide the maximum number of engageable positions for the bracket members consistent withproviding a visual impression of height rather than width of the panel. It will be appreciated, however, that so long as the slat members are closely spaced with respect to one another, the relative spacing between the connecting means is of less importance in a said display panel according to this invention.

In order to provide a further enhanced visual appearance of height to the display panel it is desirable that the slat members have their wider sides adjacent one another and their narrower sides facing outwards from either side of the display panel. A suitable cross-sectional shape of the slat members to accord with this invention could be a rectangle or similar, or could be more rounded, as with an oval or ellipse in order to give a pleasing visual effect. However, it will be appreciated that the cross-sectional shape of the slat members is not limited by this invention and may be any shape desired. Similarly, the colour and finish of the slat members is not limited by this invention, and indeed it is foreseen that for use in the shopfitting trade for example many different colours and finishes for the slat members will be available to allow flexibility of design for displays.

The display panel may comprise elongate portions arranged alternately on either side of the display panel, and preferably the alternately arranged elongate portions will take the form of corrugations of the display panel whereby flanks of the corrugations are common to corrugations on either side of the display panel and a crest of a corrugation, when the display panel is viewed from one side, will comprise a valley between two adjacent corrugations when the display panel is viewed from the other side. The form of the corrugations is not of importance, although rounded or flat crests of the corrugations are preferred to create a pleasing effect. It will thus be appreciated that the display panel according to this embodiment presents a solid aspect when viewed from either side thereof. The colour and finish of the display panel is a matter of design and taste and the invention is not limited thereby. A display panel according to the present invention may be of any desired width or height, dictated only by requirements of space and design.

The supporting means or connecting means are not limited in their form according to this invention and any suitable means which will enable a said bracket member to bwe engaged therewith may be employed.

The supporting means may conveniently comprise rod or like members passing through the series of elongate portions by means of apertures or slots in the elongate portions. The rod or like members may be vertically spaced from one another in the display panel at convenient distances to enable the bracket members to be engaged therewith for displaying goods at any desired height. Location of the rod or like members may be by suitable stop means placed upon the rod or like members, e.g., at one or both ends thereof to prevent the rod or like member from sliding through the display panel when in use. A suitable stop means is a "Starlock" (registered trade mark) washer or the like.

It is foreseen that connecting means in accordance with this invention may conveniently comprise elongate members passing through the series of slat members of any convenient length to provide a width of display panel as desired. In order to separate each slat member from its neighbour, spacers may be inserted between each slat member and said spacers may be mounted upon some or all of the connecting means and engageable with the engaging means on the bracket member. Again, in accordance with the invention, the spacers may bearranged on the display panel in any manner desired consistent with being engageable with the engaging means on the bracket members.

A convenient way to assemble a said display panel would be to have discreet said connecting means as between each adjacent pair of said slat members and to have said discreet connecting means permanently engaged with one side of each slat member with a suitable corresponding releasable receiving means in the opposite side of each slat member so that display panels could be made up to any desired width in accordance with the invention by engaging the discreet connecting means on a first slat member with the corresponding releasable receiving means on a second slat member. The spacing and regularity of the connecting means comprised in a said display panel is not limited by the invention, and indeed it is foreseen that patterns may be created in the display panel by assembling the same with varying spacings between the connecting means.

The bracket means or bracket member in accordance with this invention may take any convenient form and, in shopfitting practice for example, is likely to comprise an arm member which may be used for hanging goods to be displayed thereon. It will be appreciated by those skilled in the art however that this invention is not limited by the size, shape or configuration of the bracket member save as to its engageability with the display panel as aforesaid. A said bracket member, while being engageable with the display panel in any convenient manner may comprise engaging means which are quickly releasable to enable the bracket member to be engaged with or removed from the display panel with ease. The engaging means preferably comprise hook means e.g., spaced hook portions, for engaging the connecting means, e.g., on opposite sides of a said elongate portion whereby one or more said hook means comprised in the engaging means of a said bracket member may make hook engagement, e.g., hook over, the connecting means while restraining means comprised in the engaging means prevent the bracket member from rotating about the connecting means, or preferably an intermediate portion of a said bracket member between the spaced hook portions, may comprise the restraining means and may engage said elongate portion to prevent the bracket member from rotating about the supporting means and to support the bracket member at a required angle relative to the display panel. Said restraining means may also engage with further said connecting means or may engage one or more slat members. Preferably the engaging means comprises a pair of forked hook members extending upwardly from the bracket member to engage connecting means extending transversely from opposite sides of a said slat member and the restraining means comprises an end portion of the bracket means in the region of the apex of the pair of forked hook members which engages a front surface of the slat member encompassed by the pair of forked hook members to prevent rotation of the bracket member about the connecting means. A mounting portion of the bracket member may extend outwardly from the engaging means for mounting goods to be displayed thereon. It will be appreciated that the design of the engaging means is not to be restricted in accordance with this invention and any convenient engaging means will suffice.

Figure 2:
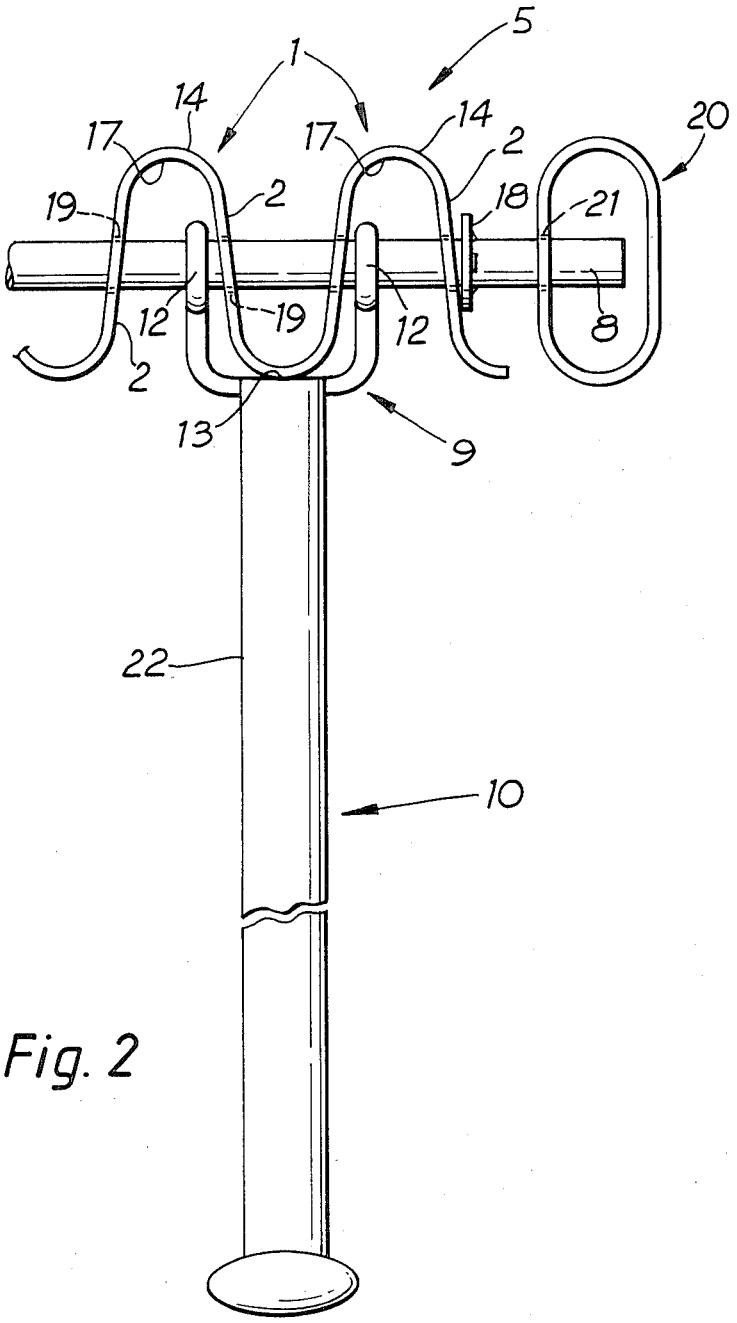

The present invention will now be more particularly described with reference to two preferred embodiments thereof as illustrated in the accompanying drawings in which:

FIG. 1 is a three-quarter front perspective view of display apparatus according to a first embodiment of this invention, and FIG. 2 is a fragmentary plan view of display apparatus according to a second embodiment of this invention.

In the drawings like parts of the two embodiments shown have been given the same reference numeral for consistency and ease of comprehension.

Referring to FIG. 1, the first enbodiment of the display apparatus comprises a series of vertical slat members 1, each comprising an oval section hollow tube of approximately 12 mm in width, the slat members 1 being arranged with their wider sides 2 adjacent one another. The separation between adjacent wider sides 2 of each slat member 1 is approximately 25 mm. A top edge 3 and a bottom edge 4 of a display panel 5 comprising the series of slat members 1 are defined by a top end 6 and a bottom end 7 of the slat members 1.

Passing transversely through the slat members 1 are connecting means 8, each comprising a rod or wire of approximately 5 mm diameter. The connecting means arespaced vertically from one another at an interval of approximately 100 mm in order to provide suitable engagement locations for engaging means 9 of bracket members 10. Mounted on the connecting means 8 between each slat member 1 is a series of cylindrical spacers 11 through which the connecting means are passed upon assembly of the display panel 5.

The engaging means 9 on each bracket member 10 comprises a forked pair of hooks 12 which engage the connecting means 8 extending traversely either side of the slat member 1. A restraining portion 13 of the engaging means 9 rests against a front surface 14 of the slat member 1 to prevent rotation of the bracket member 10 about the connecting means 8 under the weight of the bracket member 10. Goods to be displayed by the display apparatus may be hung from an arm portion 15 extending horizontally outwardly from the engaging means 9.

The top and bottom ends 6, 7 may conveniently comprise caps 16 attached to the slat members 1. With tubular slat members 1 as shown, a said cap may conveniently comprise a moulding, which may be of plastics material, inserted into the end of the tube to give a pleasing effect while providing a simple and cheap cap.

The display apparatus as shown in FIG. 1 may be mounted as desired. The display panel may terminate on either side thereof with a said slat member, of the display panel may be attached to any convenient support means. Such a support means (not shown) may suitably comprise a display post as disclosed in copending British patent application No. 8609420 wherein the connecting means extending outwardly on either side of the display panel may comprise hook portions to engage one or more apertures of said display post.

Referring to FIG. 2, the display panel 5 comprises a sheet of corrugated material, which may be for example aluminium or plastics material, particularly acrylic material. The display panel 5 comprises a series of corrugations 1 extending alternately on either side of the display panel 5. Each corrugation 20 consists of a crest 14 and two flanks 2. However it will be appreciated that a crest 14 of a corrugation 1, when the display panel 5 is viewed from one side, will become a valley 17 between two corrugations 1 when the display panel 5 is viewed from the other side.

Extending transversely through the corrugations 1 of the display panel 5 at a convenient vertical separation are a series of supporting means, each comprising a rod 8 and a pair of "Starlock" or like washers 18. Each rod 8 passes through apertures 19 formed in the flanks 2 of the corrugations 1, and is secured transversely in position by means of the "Starlock" or like washers 18 abutting flanks 2 at either end of the rod 8.

The display panel 5 is supported by support posts 1 into further apertures 21 of which the rods 8 extend. Suitable mounting means (not shown) may then be attached to the support posts 20 for mounting the display panel 5 to a wall, floor or ceiling as desired.

A bracket member 10 is engaged with the rod 8 and corrugations 1 by means of engaging means 9 comprising a pair of spaced hooks 12 which make hook engagement with the rod 8 on either side of a corrugation 1 and an intermediate portion 14 which engages the corrugation 1 to support the bracket member 10 at a required angle. In the illustrated embodiment the bracket member 10 comprises a hanging rail 22 although it could comprise a shelf support or other display means.

I claim:

1. Display apparatus comprising a display panel characterised in having in its position of use a series of parallel, vertical, closely spaced elongate portions and supporting means extending transversely of the elongate portions, with the elongate portions being hollow and more closely spaced and more substantial in cross-section than the supporting means, and at least one bracket member having engaging means for connecting said bracket member to said supporting means, said engaging means comprising a pair of connectors inserted between adjacent elongate portions and attach to the supporting means on opposite sides of at least one of said elongate portions.

2. Display apparatus according to claim 1, wherein said elongate portions comprise separate closely-spaced elongate slat members and the supporting means comprise connecting means for connecting together the elongate slat members.

3. Display apparatus comprising a display panel characterised in having, in its position of use, a series of parallel, vertical, closely spaced elongate portions comprising ribs or corrugations on a panel member and supporting means extending transversely of the elongate portions, with the elongate portions being more closely spaced and more substantial in cross section than the supporting means, and at least one bracket member having engaging means for connecting said bracket member to said supporting means, said engaging means comprising a pair of connectors inserted between adjacent elongate portions engageable with the supporting means on opposite sides of at least one of said elongate portions.

4. Display apparatus according to claim 1 or claim 3, wherein the supporting means comprises at least one rod member extending through the elongate portions.

5. Display apparatus according to claim 1 or claim 3, wherein the ends of the elongate portions define top and bottom edges of the display panel when said is in its position of use.

6. Display apparatus according to claim 3, wherein the elongate portions are arranged alternately on either side of the display panel.

7. Display apparatus according to claim 4, wherein stop means are provided on at least one rod member at at least one end thereof.

8. Display apparatus according to to claim 1 or claim 3, wherein the bracket member engaging means comprises hook means for engaging the supporting means.

9. Display apparatus according to claim 8, wherein said hook means comprises spaced hook portions adapted to make hook engagement with a said supporting means on either side of a said elongate portion and the bracket member comprises an intermediate portion which engages said elongate portion to prevent the bracket member from rotating about the supporting means.

10. Display apparatus according to claim 8, wherein said bracket member comprises a portion which extends outwardly of the display panel when the display apparatus is in use and which serves for mounting or hanging goods to be displayed or for supporting a shelf.

* * * * *